US005410967A

United States Patent [19]

Peritt

[11] Patent Number: 5,410,967

[45] Date of Patent: May 2, 1995

[54] TARGET CAMOUFLAGING CHAFF DISPENSER WITH EJECTABLE CLOSURE

[75] Inventor: Harvey L. Peritt, Beltsville, Md.

[73] Assignee: The United States of America as represented by the Secretary of the Navy, Washington, D.C.

[21] Appl. No.: 69,815

[22] Filed: Jun. 1, 1993

[51] Int. Cl.[6] ..... F42B 5/00

[52] U.S. Cl. ..... 102/439; 102/357; 102/462; 102/505; 215/253; 220/89.2; 220/261; 220/266; 222/541

[58] Field of Search ..... 102/340, 341, 352, 375, 102/438, 462, 463, 480, 489, 505, 357, 430, 434, 439; 215/253; 220/89.2, 261, 265, 266, 307; 222/135, 153, 144.5, 394, 541; 342/12

[56] References Cited

U.S. PATENT DOCUMENTS

| | | | |
|---|---|---|---|
| 3,266,372 | 8/1966 | Mack et al. . | |
| 3,430,533 | 3/1969 | Kifor et al. | 102/505 |
| 3,760,729 | 9/1973 | Freeman . | |
| 4,309,705 | 1/1982 | Ulin | 102/505 |
| 4,404,912 | 9/1983 | Sindermann | 102/505 |
| 4,586,439 | 5/1986 | Wrama | 102/505 |
| 4,607,759 | 8/1986 | Boetzkes | 220/266 |
| 4,646,643 | 3/1987 | Goldenberg | 102/430 |
| 4,941,592 | 7/1990 | Kitterman | 222/541 |
| 5,160,800 | 11/1992 | Travor et al. | 102/505 |

FOREIGN PATENT DOCUMENTS

| | | | |
|---|---|---|---|
| 1564034 | 3/1969 | France | 215/253 |

OTHER PUBLICATIONS

The World Book Encyclopedia, vol. 21, copyright 1990 p. 191.

*Primary Examiner*—Harold J. Tudor
*Attorney, Agent, or Firm*—Jacob Shuster

[57] ABSTRACT

Rigid containers held assembled together form a dispenser from which chaff is dispersed by internally generated pressure when it exceeds a predetermined ejection level to displace and remove a sealing cap from a retention position causing rupture of an associated snap-lock, followed by controlled dispersal of the chaff.

2 Claims, 2 Drawing Sheets

TARGET CAMOUFLAGING CHAFF DISPENSER WITH EJECTABLE CLOSURE

BACKGROUND OF THE INVENTION

This invention relates in general to the storage of material within a rigid container having a closure device subjected to external closure disengaging forces while ejection of said stored material by pressure internally generated within the container exceeding a preset limit is predetermined by the retention force associated with such closure device.

Closure caps on chaff dispensing canisters carried by aircraft are subjected to high external acceleration and deceleration forces during take-off and landing, especially with respect to naval aircraft carrier decks. The closure cap retention force for such chaff dispensers must therefore be greater than the maximum aircraft deceleration forces, anticipated for example during arrested aircraft landing on naval carrier decks. The cap retention force must however be less than the cap disengaging force exerted by internal pressure generated in response to propellant charge ignition for chaff ejection purposes during aircraft flight. The chaff ejection pressure must not, however, be too high so as to avoid dispersal of ejected chaff by an excessive distance defeating its camouflaging function. The generation of excessively high chaff ejection pressure may also rupture or split the chaff storing cannister causing a reduction in chaff propelling forces before cap disengagement. Furthermore, relatively high ejection pressure was heretofore found necessary to effect cap disengagement. The foregoing problems associated with the establishment of appropriate closure cap retention and disengaging forces to meet chaff dispensing conditions, was aggravated by currently available chaff camouflage ejection systems wherein a body chaff material is ejected in increments.

Accordingly, it is an important object of the present invention to provide a closure device for a chaff dispenser which will more reliably meet various conflicting chaff dispensing requirements by means of a relatively low cost closure construction and simple closure insertion procedure.

SUMMARY OF THE INVENTION

In accordance with the present invention, a rigid chaff dispensing container, which may be rocket launched, has a rigid chaff ejection end closed by a closure cap. Deformable notched formations in the form of snap-lock elements hold the cap in a retention position within the container with a preset retention force. The cap has a guide portion from which the deformable elements extend positioned in alignment with anchor openings in the container during insertion by manual displacement. The deformable elements during guided insertion of the cap into the dispensing container engage a beveled rim surface formation at the ejection end of the container to resist insertion and cause flexing of the elements until they enter the anchor openings when the cap reaches the retention position. Subsequent build-up of internal pressure within the container generated by propellant ignition during dispenser launch is thereby accommodated. When such internal pressure reaches a proper chaff ejection level, the cap is forwardly displaced from its retention position under a rupture force producing a clean break-off of the deformable elements at rupture locations of minimum tensile strength; thereby freeing the cap from the container for dispersal of the chaff without interference. Such chaff ejection level of the internal pressure is slightly above the closure cap retention force established by the foregoing snap-lock action of the deformable elements.

BRIEF DESCRIPTION OF DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENT

Figure 1:
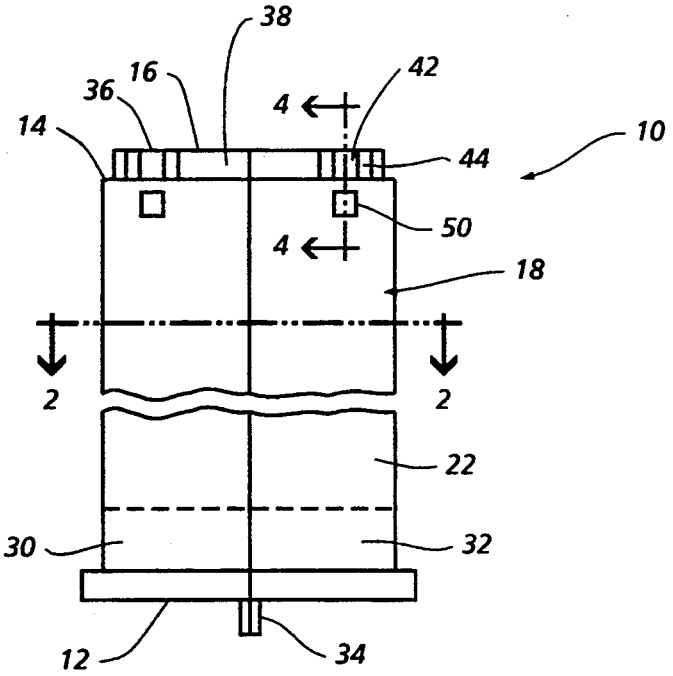
FIG. 1 is a side elevation view of a fully assembled chaff dispenser cartridge constructed in accordance with one embodiment of the invention.

Referring now to the drawing in detail, FIG. 1 illustrates a target camouflaging chaff dispenser cartridge generally referred to by reference numeral 10. In the illustrated embodiment, the dispenser cartridge 10 is of a generally cylindrical shape from which chaff is adapted to be rocket launched into the air under suitable propelling forces applied to one axial end 12 of the cartridge. During movement through the air, a body of material in the form of camouflaging chaff stored within the dispenser cartridge is dispersed forwardly in the direction of such movement from an ejection end 14 opposite the end 12. The chaff is retained within the dispenser cartridge prior to dispersal from the ejection end 14 by a closure assembly generally referred to by reference numeral 16 in FIG. 1.

Figure 2:
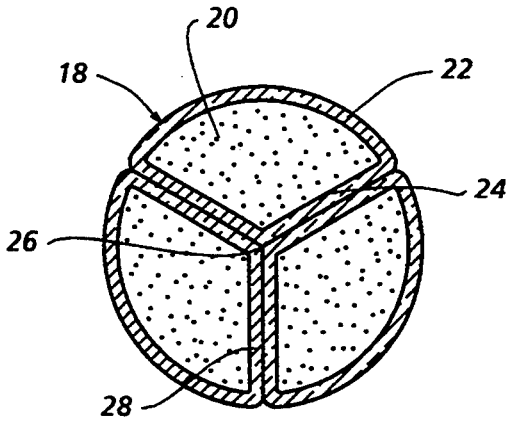
FIG. 2 is a transverse section view taken substantially through a plane indicated by section line 2—2 in FIG. 1.

According to the embodiment of the invention shown in FIGS. 1 and 2, the dispenser cartridge 10 is formed by an assembly of three segmental containers or canisters 18 within which incremental amounts 20 of the chaff is stored. Each container 18 is made of a suitable rigid plastic material having a crosssection formed by an outer arcuate wall portion 22 connected to two radial wall portions 24 diverging from an inner apex 26 at an angle of 120° . Accordingly, the radial wall portions 24 of the respective containers 18 abut along radial surfaces 28 ultrasonically bonded to each other according to one embodiment to form a cylindrical shaped cartridge assembly. An ignitable pyrotechnic type of known propellant device 32 is located within the containers, as indicated by dotted line in FIG. 1. Ignition of the propellant device 32 for ejection of the chaff 20 is effected by suitable means generally well known in the art, through electrodes 34 projecting rearwardly from the containers at the axial end 12 of the dispenser cartridge.

In response to ignition of the propellant device 32, pressure is internally generated within the respective containers 18 of the cartridge for sequential ejection of the chaff 20 from end 14 of the dispenser cartridge. Chaff ejection occurs when the pressure exceeds a predetermined limit to exert a displacing force on the closure assembly 16 exceeding a lower closure retention force holding closure caps 36, associated with the closure assembly 16, seated on the ejection end 14 of the chaff dispenser cartridge. Each cap 36 is forceably inserted into a container 18 at the ejection end 14 so as to be locked in place in a retention position as shown in FIGS. 1 and 4.

Figure 3:
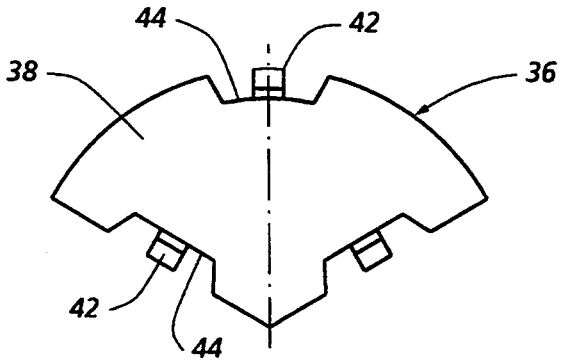
FIG. 3 is a top plan view of one of the closure caps associated with the chaff dispenser cartridge illustrated in FIG. 1.
Figure 4:
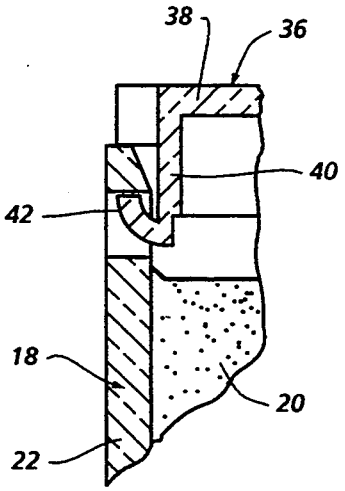
FIG. 4 is an enlarged partial section view taken substantially through a plane indicated by section line 4—4 in FIG. 1.

The construction of each cap 36, as more clearly seen in FIGS. 3 and 4, includes a relatively flat sealing cover 38 of arcuate segmental shape dimensioned to abut the container at the ejection end 14 in the retention position of the cap. A relatively rigid guide portion 40 of the cap projects axially from the cover 38 into the container as shown in FIG. 4. Insertion of each cap to its retention position is resisted by container engagement with elastically deformable snap-lock elements or nibs 42 projecting from the inner end of the guide portion 40 forming therewith a notch space 41. In the illustrated embodiment, three of such snap-lock elements 42 are aligned with notched edge portions 44 of the cap formed in arcuate edge 46 and radial edges 48 of each cap cover 38, as more clearly seen in FIG. 3. The respective snap-lock elements 42 are furthermore aligned, by the guide portion 40 of the cap 36 during insertion, with rectangular anchor openings 50 in each of the three container wall portions 22 and 24, in close adjacency to the end 14. When the cap is seated in its retention position closing a container 18 as shown in FIGS. 1 and 4, the snap-lock elements 42 received within the anchor openings 50 are thereby relieved of any stress induced therein by flexure during insertion of the cap into its container.

Figure 4A:
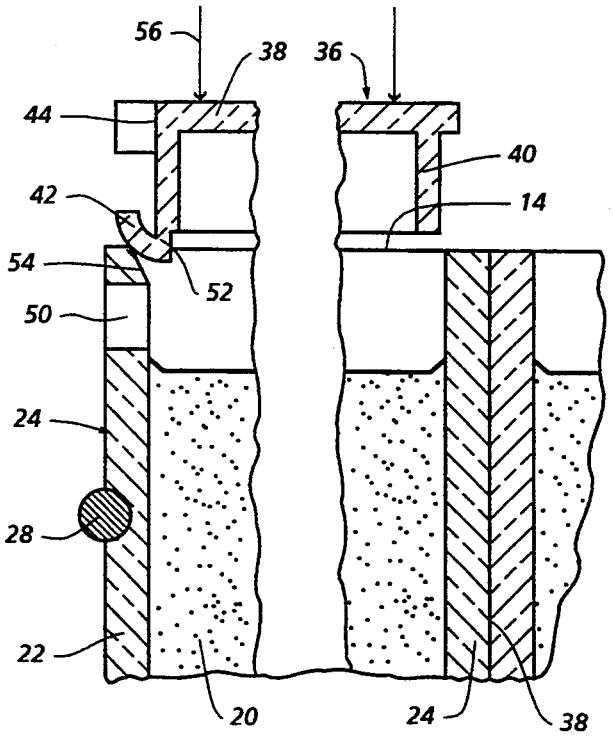
FIGS. 4A, 4B and 4C are partial section views corresponding to FIG. 4, showing different stages of closure cap insertion into and ejection from the chaff dispenser cartridge of FIGS. 1-3.
Figure 4B:
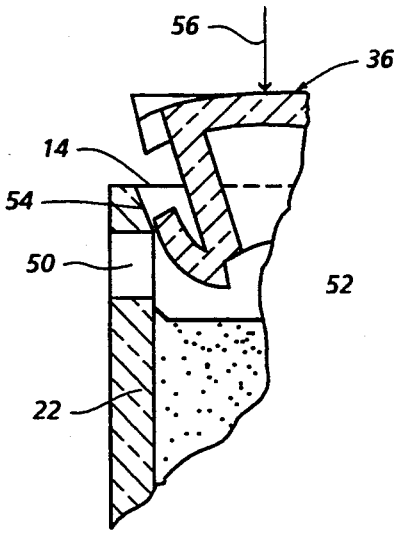
Figure 4C:
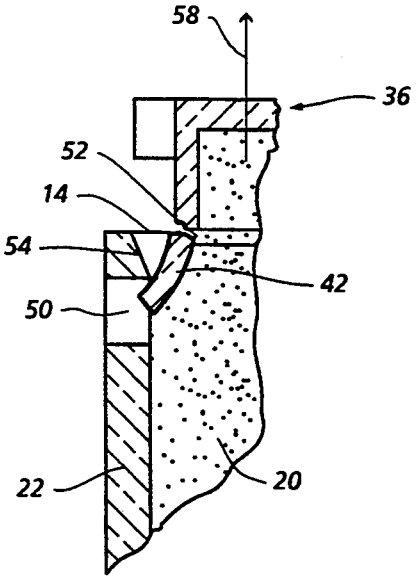

FIGS. 4A and 4B illustrate forceable guided insertion of a cap 36 into its container 18 before the cap reaches its retention position shown in FIG. 4. Initially, the curved, snap-lock elements 42, which are attached at root end portions 52 thereof to the inner end of the guide portion 40 of the cap, engage a beveled surface on a rim formation 54 at the ejection end 14 of the container. Thus, continued insertion of the cap guided by portion 40 into the container, is resisted as the lock elements 42 undergo elastic deformation producing compressive stress therein without rupture during sliding contact with the rim formation 54. The cap insertion force, as denoted by arrows 56 in FIGS. 4A and 4B, while sufficient to effect such flexure of the snap-lock elements 42, is relatively low so as to accommodate manual insertion of the caps to their retention positions. Such cap insertion force is furthermore substantially less than the retention force subsequently holding the cap in its retention position which predetermines the magnitude of a cap displacing rupture force, denoted by arrow 58 in FIG. 4C. The cap displacing force 58 is exerted by the internal container pressure aforementioned exceeding a chaff ejection level to cause the snap-lock elements 42 on the cap to be bent outwardly from the anchor openings 50 and rupture in response to engagement with edges of openings 50 at the root end portions 52 of the elements as shown in FIG. 4C. Accordingly, clean break type rupture of the lock elements 42 occur at the root end portions 52 having minimum tensile strength, to free the cap from retention in the container and permit dispersal of the chaff 20 therefrom without cap interference.

It will be apparent from the foregoing description, that the chaff dispenser cartridge 10 is so constructed as to accommodate the design and selection of material for its closure assembly 16 necessary to enable manual insertion of the closure caps 36 under low insertion forces 56 and yet develop cap retention forces sufficiently high to resist cap disengagement by external forces exerted on the dispenser cartridge, such as aircraft deceleration forces. The snap-lock arrangement of the elements 42 and anchor openings 50 is such as to establish a predetermined ejection pressure level that is exceeded by the internal pressure generated in response to ignition of the propellant charge device 32 following launch. When such pressure level is reached, the cap displacing force 58 exerted on the cap 36 exceeds the cap retention force aforementioned to an extent necessary to cause a clean break type of rupture of the lock elements 42 at the root ends 52 thereof, so as to free the cap 36 from its container 14 and permit chaff dispersal by a desired distance from the opened ejection end 14 of the dispenser without interference.

Numerous other modifications and variations of the present invention are possible in light of the foregoing teachings. It is therefore to be understood that within the scope of the appended claims the invention may be practiced otherwise than as specifically described.

What is claimed is:

1. In combination with a rigid container enclosing a body of material to be dispersed under a predetermined ejection pressure, propellant means for producing said predetermined ejection pressure within said container, closure means for retaining said body of material within the container under a retention force prior to dispersal thereof, comprising: a rim formation on the container defining an opening from which the body of material is ejected under said predetermined ejection pressure, a cap having a sealing cover portion abutting the rim formation in a retention position of the closure means and a relatively rigid guide portion extending from the cover portion into said opening in the container, a plurality of lock means projecting from the guide portion of the cap for elastic deformation in response to engagement with the rim formation during insertion of the cap into the container through said opening under an insertion force less than said retention force each locking means comprises a flexure element having a root end portion of minimum rupture resisting strength attached to said guide portion and a plurality of anchor means on the container receiving the plurality of lock means in said retention position of the closure means for relieving stress induced in the plurality of lock means by said insertion of the cap, said plurality of said anchor means being located in spaced adjacency to the rim formation each anchor means comprising a through hole having an edge engaged by one of the lock means causing rupture thereof in response to said predetermined ejection pressure exerted on the cap.

2. The combination of claim 1 wherein said body of material is target camouflaging chaff.

* * * * *